United States Patent [19]

Rogen

[11] 4,018,308

[45] Apr. 19, 1977

[54] ELEVATING BY SHAPE MEMORY INDUCTION

[76] Inventor: Neil E. Rogen, 3 Beaver Dam Road, Upper Saddle River, N.J. 07458

[22] Filed: Oct. 23, 1975

[21] Appl. No.: 625,322

[52] U.S. Cl. ..... 187/17; 187/1 R; 254/135 R

[51] Int. Cl.[2] ..... B66B 11/04

[58] Field of Search ..... 187/1 R, 3, 4, 5, 17, 187/20, 26, 27, 67; 254/135 R

[56] References Cited

UNITED STATES PATENTS

| | | | |
|---|---|---|---|
| 3,440,997 | 4/1969 | Rogen et al. | 116/114.5 |
| 3,483,748 | 12/1969 | Rogen et al. | 73/339 |
| 3,483,752 | 12/1969 | Rogen et al. | 73/362.8 |

*Primary Examiner*—Evon C. Blunk
*Assistant Examiner*—James L. Rowland
*Attorney, Agent, or Firm*—Jerry Cohen; Charles Hieken

[57] ABSTRACT

Elevating is carried out in a noiseless, relatively frictionless manner with efficient utilization of energy by hanging an elevator from an elongated metal cable of shape memory material which elongates under gravity loading and, upon application of heat thereto, contracts in length to raise a load suspended by the cable.

3 Claims, 1 Drawing Figure

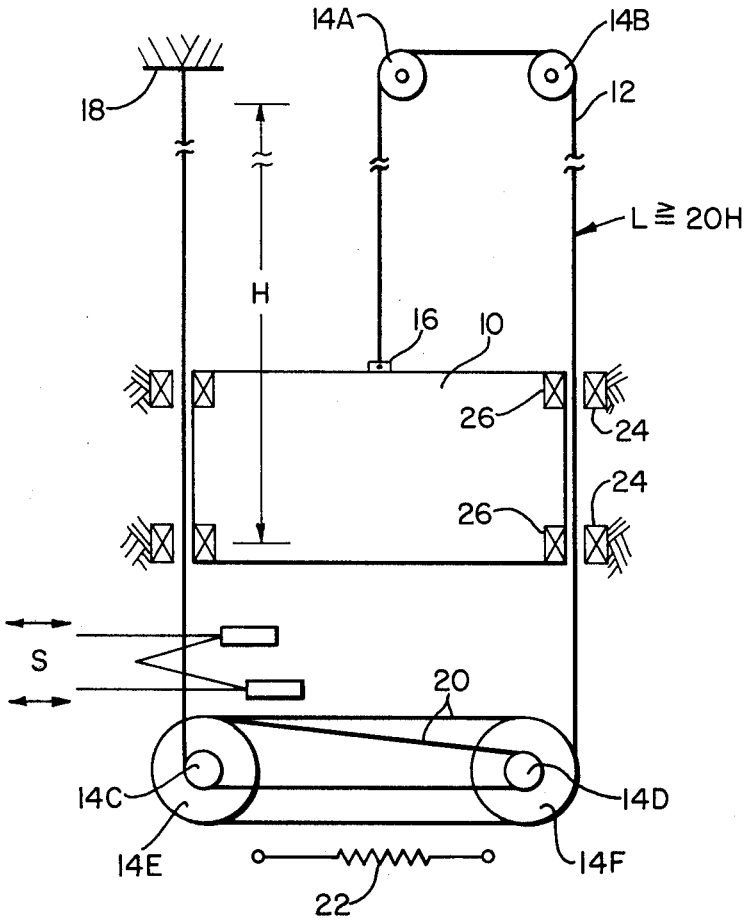
14A
14B
18
12
L ≧ 20H
H
16
10
26
24
24
26
S
20
14C
14D
14E
14F
22

ELEVATING BY SHAPE MEMORY INDUCTION

BACKGROUND OF THE INVENTION

The present invention relates to elevators, and like conveyors, for moving people and materials such as passenger and freight elevators, cranes, fork lifts, stackers, floor levelers, tail gates, gantry cranes and work tables and is particularly characterized by elevation in a noiseless manner with relatively low friction and relatively high efficiency in utilization of energy and reduced vulnerability to breakage consistent with small volume envelope of accessory equipment.

Elevating apparatus of the class described above uses mechanical or hydraulic transmission to convert power from a prime mover, usually an electric motor, to an elevating and/or lowering drive motion.

It is an important object of the present invention to provide elevating apparatus with reduced reliance on mechanical or hydraulic transmissions and their associated noise, friction and mechanical breakdown vulnerabilities.

It is a further object of the invention to provide a long life, reliable elevating apparatus consistent with one or both of the preceding objects.

It is a further object of the invention to provide precise control of elevating movement consistent with one or more of the preceding objects.

SUMMARY OF THE INVENTION

A long cable of shape memory metal suspends the elevated load. Such shape memory materials are described in my prior U.S. Pat. Nos. 3440997, 3483752, 3483748 (Assigned to Avco Corp., Cincinnati, Ohio), the disclosures of which are incorporated herein by reference as though set out at length herein.

The characteristic of a rod or cable of such shape memory material may be summarized simply herein as the capability of elongating under tensile loading up to about 7–8% [although as a practical matter only about half such elongation capability will be utilized] at a first temperature T, below a critical transition temperature range (TTR) of the material and then upon heating to an elevated temperature $T_2$ equalling or exceeding the TTR, automatically contracting to the original length, i.e., remembering and restoring its original shape. The heating temperature can be controlled for partial contractive restoration of original elongation. The process is sufficiently reversible for essentially all permutations of up and down movements of elevating apparatus of the class initially described above and can undergo long periods of repeated cycling without noticable degradation in the nature of fatigue or creep.

The utilization of shape memory cable (also including within the term "cable" as used herein, rod, wire, ribbon, sheet and other equivalent forms of material) in elevating apparatus in accordance with the present invention is implemented by suspending an elevating load such as an elevator car from such a cable and providing a usable cable length, L, which is a $1/e$ multiple of effective elevating height, H, to be traversed wherein $e$ is the percent elongation of cable length to be utilized in a particular installation. Such length is from about 10–30H and may be established by multiple runs of cable back and forth over pulleys or other low friction guides.

One end of the cable is anchored to fixed ground or building structure and one end is secured to the elevating load. Thermal control means of heating and/or cooling types to directly or indirectly control temperature of the shape memory cable to induce its shape memory behavior.

In such an arrangement, the apparatus can cycle many thousands of times over the course of several months of usage without noticeable degradation effects in the nature of creep, fatigue or irreversible elongation. The response time of the cable for shape memory once heated to or above TTR is on the order of a second.

Thermal cycling of the cable may be profiled for acceleration and deceleration at the beginning and end of movements.

Other objects, features and advantages of the invention will be apparent from the following detailed description of preferred embodiments taken in connection with the accompanying drawing, the single FIGURE of which:

BRIEF DESCRIPTION OF THE DRAWING

The sole FIGURE is a schematic view of a elevating apparatus according to a preferred embodiment of the invention applied as a passenger elevator.

DETAILED DESCRIPTION OF PREFERRED EMBODIMENTS

Referring now to the single FIGURE of the drawing, there is shown an elevator car 10 suspended from a cable 12. The cable typically comprises a bundle of 100–500 20 mil wires of shape memory material as described above. The cable passes over pulleys 14A–14F and at end, 16, is secured to the elevator car and at the other end, 18, is secured to fixed structure of the building containing the elevator shaft. The cable has several runs, back and forth, between pulleys 14E and 14F in the region indicated at 20 to establish a total length L of 20H, i.e., twenty times the effective height of the elevator path of travel, consistent with remaining in the volume envelope of the elevator shaft.

An indirect heater is indicated at 22. But it will be understood that the cables may alternatively be directly heated by application of terminals of heating circuit at ends 16 or 18 or therebetween (e.g., at two of the pulleys, e.g., at shafts of pulleys 14E/C and 14D/F.

Conventional elevator auxiliary structure (not shown) including counterweight, guide rail(s), safety rope with arresting jaws and centrifugal governor, stop switches and door interlock systems may also be employed consistent with the present invention.

A series of retractable limiting stops is arranged along the path of the elevator car 10. The net weight of the car loaded or unloaded is allowed to descend under gravity, with or without dynamic braking, to the topmost extended stop S. Such descent stretches the cable 12. For ascent, the cable is heated by heater 22 to the TTR of the cable to reverse the stretching by a shape memory contraction of the cable which raises the car.

Typically, using nickel-titanium, the cable requires 40,000 psi on cooling to elongate 5% and on heating 95,000 psi is the stress level available at that strain; i.e., load increase equals the equivalent of 55,000 psi. A 20 mil Ni-Ti wire cabled to lift two tons and stretch to 5% at one ton load would require 160 cabled 1,200 ft. long wires to get 60 ft. expansion at 5% strain.

Taking a conservative estimate of friction loss at 10% which is greater than one would encounter normally, especially if the wire is coiled on fishing reel type device, with individual spool containers for each loop it is seen that there is enough leeway to cover the frictional loss on lifting.

In accordance with a further aspect of the invention, bearing pads 24 may be provided on fixed elevator shaft defining structure and/or pads 26 may be provided on the elevator car for limiting cable vibration.

The pulleys 14A–F may be rotatable or may be non-rotatable fixed lubricated cylinders.

All the cable could be held in a fishing reel type of payout device with concentric spools, all on bearings. Thus a 1,200 foot line could be confined to a small area. The reel could then be only heated and/or cooled in sections or entirely.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and technique herein disclosed and limited solely by the scope and spirit of the appended claims.

What is claimed is:

1. Elevating apparatus comprising, means defining an elevator load member for cyclically travelling a limited vertical path, means defining a shape memory cable carrying and suspending said elevator load and comprising cabled wires of an alloy comprising at least one metal selected from the group consisting of nickel, iron and cobalt and further comprising titanium, the weight of the elevator load being sufficient to elongate said cable at a first relatively cold temperature, and specific means for electrically heating said cable to reverse said elongation by induction of shape memory contraction, to provide lowering and raising portions of elevating cycles.

2. Elevating apparatus in accordance with claim 1 wherein the heating means comprise means for direct electrical resistance heating of the shape memory material.

3. Elevating apparatus in accordance with claim 1 wherein the heating means comprise electrical resistance means indirectly heating the shape memory material.

* * * * *